US009103036B2

(12) United States Patent
Kumar et al.

(10) Patent No.: US 9,103,036 B2
(45) Date of Patent: Aug. 11, 2015

(54) HARD COATINGS COMPRISING CUBIC PHASE FORMING COMPOSITIONS

(71) Applicant: Kennametal Inc., Latrobe, PA (US)

(72) Inventors: Vineet Kumar, Latrobe, PA (US); Ronald Penich, Greensburg, PA (US); Yixiong Liu, Greensburg, PA (US)

(73) Assignee: KENNAMETAL INC., Latrobe, PA (US)

( * ) Notice: Subject to any disclaimer, the term of this patent is extended or adjusted under 35 U.S.C. 154(b) by 133 days.

(21) Appl. No.: 13/837,028

(22) Filed: Mar. 15, 2013

(65) Prior Publication Data

US 2014/0272391 A1 Sep. 18, 2014

(51) Int. Cl.
*C23C 28/00* (2006.01)
*C23C 28/04* (2006.01)

(52) U.S. Cl.
CPC ..... *C23C 28/044* (2013.01); *Y10T 428/265* (2015.01); *Y10T 428/31678* (2015.04)

(58) Field of Classification Search
USPC ..... 51/307, 309; 428/336, 697, 698, 699; 407/119
See application file for complete search history.

(56) References Cited

U.S. PATENT DOCUMENTS

| | | | |
|---|---|---|---|
| 5,296,016 | A | 3/1994 | Yoshimura |
| 5,712,030 | A | 1/1998 | Goto et al. |
| 6,033,734 | A | 3/2000 | Muenz et al. |
| 6,040,012 | A | 3/2000 | Anderbouhr et al. |
| 6,071,560 | A | 6/2000 | Braendle et al. |
| 6,077,596 | A | 6/2000 | Hashimoto et al. |
| 6,103,357 | A | 8/2000 | Selinder et al. |
| 6,110,571 | A | 8/2000 | Yaginuma et al. |
| 6,250,855 | B1 | 6/2001 | Persson et al. |
| 6,274,249 | B1 | 8/2001 | Braendle et al. |
| 6,333,099 | B1 | 12/2001 | Strondl et al. |
| 6,382,951 | B1 | 5/2002 | Soderberg et al. |
| 6,395,379 | B1 | 5/2002 | Braendle |
| 6,558,749 | B2 | 5/2003 | Braendle |
| 6,565,957 | B2 | 5/2003 | Nakamura et al. |
| 6,572,991 | B1 | 6/2003 | Ruppi |
| 6,586,122 | B2 | 7/2003 | Ishikawa et al. |
| 6,599,062 | B1 | 7/2003 | Oles et al. |
| 6,669,747 | B2 | 12/2003 | Salmon |

(Continued)

FOREIGN PATENT DOCUMENTS

| | | |
|---|---|---|
| CN | 1276024 A | 12/2000 |
| CN | 1316545 A | 10/2001 |

(Continued)

OTHER PUBLICATIONS

Rauch, J.Y., et al., "Structure and Compositions of TixAl1−xN Thin Films Sputter Deposited Using a Composite Metallic Target," Surface and Coatings Technology 157 (2002) pp. 138-143.

(Continued)

*Primary Examiner* — Archene Turner
(74) *Attorney, Agent, or Firm* — Matthew W. Gordon

(57) ABSTRACT

Refractory coatings for cutting tool applications and methods of making the same are described herein which, in some embodiments, permit incorporation of increased levels of aluminum into nitride coatings while reducing or maintaining levels of hexagonal phase in such coatings. Coatings and methods described herein, for example, employ cubic phase forming compositions for limiting hexagonal phase in nitride coatings of high aluminum content.

22 Claims, 7 Drawing Sheets

(56) References Cited

U.S. PATENT DOCUMENTS

| | | | | |
|---|---|---|---|---|
| 6,688,817 | B2 | 2/2004 | Borschert et al. | |
| 6,737,178 | B2 | 5/2004 | Ota et al. | |
| 6,811,581 | B2 | 11/2004 | Yamada et al. | |
| 6,824,601 | B2 | 11/2004 | Yamamoto et al. | |
| 6,838,151 | B2 | 1/2005 | Kato | |
| 6,844,069 | B2 | 1/2005 | Braendle et al. | |
| 6,866,921 | B2 | 3/2005 | Grab et al. | |
| 6,884,499 | B2 * | 4/2005 | Penich et al. | 428/336 |
| 6,924,454 | B2 | 8/2005 | Massa et al. | |
| 7,018,726 | B2 | 3/2006 | Usami et al. | |
| 7,056,602 | B2 | 6/2006 | Horling et al. | |
| 7,083,868 | B2 | 8/2006 | Horling et al. | |
| 7,094,479 | B2 | 8/2006 | Sato et al. | |
| 7,169,485 | B2 | 1/2007 | Kohara et al. | |
| 7,188,463 | B2 | 3/2007 | Schuller et al. | |
| 7,348,074 | B2 | 3/2008 | Derflinger | |
| 7,410,707 | B2 | 8/2008 | Fukui et al. | |
| 7,431,988 | B2 | 10/2008 | Hanyu et al. | |
| 7,510,761 | B2 | 3/2009 | Kondo et al. | |
| 7,524,569 | B2 | 4/2009 | Okamura et al. | |
| 7,537,822 | B2 | 5/2009 | Ishikawa | |
| 7,592,076 | B2 | 9/2009 | Flink et al. | |
| 7,597,951 | B2 | 10/2009 | Bjormander et al. | |
| 7,767,319 | B2 | 8/2010 | Åkesson et al. | |
| 7,767,320 | B2 | 8/2010 | Endler | |
| 7,838,132 | B2 | 11/2010 | Ahlgren et al. | |
| 8,025,956 | B2 | 9/2011 | Yamamoto et al. | |
| 8,034,438 | B2 | 10/2011 | Sundstrom et al. | |
| 8,084,148 | B2 | 12/2011 | Larsson et al. | |
| 8,227,098 | B2 | 7/2012 | Astrand | |
| 8,277,958 | B2 | 10/2012 | Ni et al. | |
| 8,389,134 | B2 | 3/2013 | Van Den Berg et al. | |
| 8,394,513 | B2 | 3/2013 | Van Den Berg et al. | |
| 8,409,696 | B2 * | 4/2013 | Johansson et al. | 428/697 |
| 8,409,702 | B2 | 4/2013 | Ni et al. | |
| 2002/0136933 | A1 | 9/2002 | Braendle | |
| 2006/0154051 | A1 | 7/2006 | Ahlgren | |
| 2006/0219325 | A1 | 10/2006 | Kohara | |
| 2006/0222893 | A1 | 10/2006 | Derflinger | |
| 2006/0257562 | A1 | 11/2006 | Tamagaki et al. | |
| 2007/0059558 | A1 | 3/2007 | Schier | |
| 2007/0148496 | A1 | 6/2007 | Takaoka et al. | |
| 2007/0275179 | A1 | 11/2007 | Strand et al. | |
| 2007/0292671 | A1 | 12/2007 | Akesson et al. | |
| 2007/0298280 | A1 | 12/2007 | Omori | |
| 2008/0286608 | A1 | 11/2008 | Quinto et al. | |
| 2008/0299383 | A1 | 12/2008 | Martensson et al. | |
| 2009/0075114 | A1 | 3/2009 | Hovsepian et al. | |
| 2009/0098372 | A1 | 4/2009 | Ishii et al. | |
| 2009/0123779 | A1 | 5/2009 | Endler | |
| 2009/0130434 | A1 * | 5/2009 | Zhu et al. | 407/119 |
| 2009/0297835 | A1 | 12/2009 | Okada et al. | |
| 2011/0020079 | A1 | 1/2011 | Tabersky et al. | |
| 2011/0081539 | A1 | 4/2011 | Ni | |
| 2012/0201615 | A1 | 8/2012 | Ni et al. | |

FOREIGN PATENT DOCUMENTS

| | | | |
|---|---|---|---|
| EP | 0899359 | A1 | 3/1999 |
| EP | 0492059 | B1 | 7/2000 |
| EP | 0558061 | B1 | 8/2000 |
| EP | 0801144 | B1 | 5/2001 |
| EP | 1122334 | A1 | 8/2001 |
| EP | 0709353 | B1 | 6/2002 |
| EP | 0885984 | B1 | 7/2002 |
| EP | 1219723 | | 7/2002 |
| EP | 1017870 | B1 | 10/2002 |
| EP | 1021584 91 | | 11/2003 |
| EP | 1087026 | B1 | 11/2003 |
| EP | 1038989 | B1 | 6/2004 |
| EP | 1122226 | B1 | 3/2006 |
| EP | 1683875 | A2 | 7/2006 |
| EP | 1690959 | A2 | 8/2006 |
| EP | 1099003 | B1 | 9/2006 |
| EP | 1698714 | A2 | 9/2006 |
| EP | 1702997 | A2 | 9/2006 |
| EP | 1726686 | A1 | 11/2006 |
| EP | 1736565 | A1 | 12/2006 |
| EP | 1757389 | A1 | 2/2007 |
| EP | 1825943 | A1 | 8/2007 |
| EP | 1674597 | B1 | 1/2008 |
| JP | 06-136514 | * | 5/1994 |
| JP | 08-209333 | | 8/1996 |
| JP | 09-300106 | | 11/1997 |
| JP | 2001-234328 | | 8/2001 |
| JP | 2002-003284 | | 1/2002 |
| JP | 2002187004 | A | 7/2002 |
| JP | 2002-263941 | * | 9/2002 |
| JP | 2003-0127003 | | 5/2003 |
| JP | 2003-136302 | | 5/2003 |
| JP | 2003-175405 | A | 6/2003 |
| JP | 2006-152321 | A | 6/2006 |
| JP | 2006-181706 | A | 7/2006 |
| JP | 2007229919 | A | 9/2007 |
| WO | 0070120 | A1 | 11/2000 |
| WO | 03085152 | A2 | 10/2003 |
| WO | 2005111257 | A2 | 11/2005 |
| WO | 2006041366 | A1 | 4/2006 |
| WO | 2006080888 | A1 | 8/2006 |
| WO | 2007003648 | A1 | 1/2007 |
| WO | 2008037556 | A2 | 4/2008 |
| WO | 2008059896 | A1 | 5/2008 |
| WO | 2009031958 | A1 | 3/2009 |
| WO | 2009127344 | A1 | 10/2009 |

OTHER PUBLICATIONS

Ahlgren, M., et al., "Influence of Bias Variation on Residual Stress and Texture in TiAlN PVD Coatings," Surface & Coatings Technology 200 (2005) pp. 157-160.

ISA/KR, PCT Written Opinion and International Search Report for PCT/US2010/047457 (mailed May 2, 2011).

PalDey et al., "Single layer and Multilayer Wear Resistant Coatings of (Ti, Al)N: A Review," Mat. Sci. Engineer., A342 (2003) 58-79.

Musil et al., "Superhard Nanocomposite Ti1-xAlxN Films Prepared by Magnetron Sputtering," Thin Solid Films 365 (2000) 104-109.

Horling et al., "Mechanical Properties and Machining Performance of Ti1–xAlxN-Coated Cutting Tools," Surface & Coating Tech. 191 (2005) 384-392.

Hakansson et al., "Microstructure and Phys. Prop. of Polycrystalline Metastable Ti0.5Al0.5N alloys Grown by D.C. Magnetron Sputter Dep.," Thin Solid Films 191 (1987) 55-65.

Huang et al., "Dep. of (Ti,Al)N films on A2 Tool Steel by Reactive R.F. Magnetron Sputtering," Surface and Coatings Tech. 71 (1995) 259-266.

Arndt et al., "Performance of New AlTiN Coatings in Dry and High Speed Cutting," Surface and Coatings Tech. 163-164 (2003) 674-680.

Cremer et al., "Optimization of (Ti,Al)N Hard Coat. by a combinatorial Appr." Int. J. Inorganic Mat. 3 (2001) 1181-1184.

Suzuki et al., "Microstructure of Grain Boundaries of (Ti,Al)N Films," Surface and Coatings Tech. 107 (1998) 41-47.

Endrino et at., "Hard AlTiN, AlCrN PVD Coatings for Machining of Austenitic Stainless Steel," Surface and Coatings Tech. 200 (1986) 6840-6845.

Munz, "Titanium Aluminum Nitride Films: A New Alternative to TiN Coatings," J. Vacuum Sci. Tech. A 4(6) (1986) 2717-2725.

Zhou et al., "Phase Transition and Properties of Ti—Al—N Thin Films Prepared by R. F.-Plasma Assisted Magnetron Sputtering," Thin Solid Films 339 (1999) 203-208.

Tanaka et al., "Properties of (Ti1-xAlx)N coatings for Cutting Tools Prepared by the Cathodic Arc Ion Plating Method," J. Vacuum Sci. Tech. A 10(4) (1992) 1749-1756.

Horling et al., "Thermal Stability of Arc Evaporated high Aluminum-Content Ti1-xAlxN Thin Films," J. Vacuum Sci. Tech. A 20(5) (2002) 1815-1823.

Ikeda et al., "Phase Formation and Characterization of Hard Coatings in the Ti—Al—N System Prepared by the Cathodic Arc Ion Plating Method," Thin Solid Films 195 (1991) 99-110.

(56) References Cited

OTHER PUBLICATIONS

Kimura et al., "Metastable (Ti1-xAlx)N Films with Different Al Content," J. Mat. Sci. Letters 19 (2000) 601-602.
Cremer et al., "Exp. Determination of Metastable (Ti, Al)N Phase Diagram up to 700C," Val. Addition Metallurgy, Cho & Sohn, Editors, the Min. Metals, & Mat. Soc (1998) 249-258.
Endler et al Novel aluminum-rich T(1−x)Al(x)N coatings by LPCVD. Surface & Coatings Techn 203 (2008) p. 530-533.
Fox-Rabinovich et al "Effect of temperature of annealing below 900 C on structure, properties and tool life of an AlTiN coating under various cutting conditions". Surface & Coatings Techn 202 (2008) p. 2985-2992.
Kutchej et al Structure, mechanical and tribological properties of sputtered Ti(1−x)Al(x)N coatings with 0.5<=x=<0.75. Surface & Coatings Techn 200 (2005) p. 23582365.
Santana et al "The role of hcp-AlN on hardness behavior of Ti(1−x)Al(x)N nanpocomposite during annealing" ThinSolid Films 469-470 (2004) p. 399-344.
Mayrhofer et al, Influence of the A1 distribution on the structure, elastic properties, and phase stability of supersaturated Ti1-xA1xN, Journal of Applied Physics, 2006, pp. 6-10, vol. 100, 094906, American Institute of Physics.
Shimada et al, Preparation of (Ti1-xA1x)N films from mixed alkoxide solutions by plasma CVD, Thin Solid Films, 2000, vol. 370, pp. 146-150, Elsevier.
Kim et al, High temperature oxidation of (Ti1-xA1x)N coatings made by plasma enhanced chemical vapor disposition, J. Vac. Sol. Technol. A, Jan./Feb. 1999, pp. 133-137, vol. 17, No. 1.
Sproul, William D., Physical vapor deposition tool coatings, Surface and Coatings Technology, 1996, pp. 1-7, vol. 81.
Lee et al., (Ti1-xA1x)N coatings by plasma-enhanced chemical vapor deposition, J. Vac. Sci. Technol. A, Jul./Aug. 1994, pp. 1602-1607, vol. 12, No. 4.
Weber et al "Cathodic arc evaporation of (Ti,Al)N coatings and (Ti,Al)N/TiN multilayer-coatings-correlation between lifetime pf coated cutting tool, structural and mechanical film properties" Surface & Coatings Tech. 177-178, (2004) p. 227-232.
Derflinger et al., Mechanical and structural properties of various alloyed TiAlN-based hard coatings, Surface Coatings & Technology, 2006, pp. 4693-4700, vol. 200, Elsevier B.V.
Bobzin et al., Grain size evaluation of pulsed TiAlN nanocomposite coatings for cutting tools, Thin Solid Films, 2007, pp. 3681-3684, vol. 515, Elsevier B.V.
G. Abadias, Stress and preferred orientation in nitride-based PVD coatings, Surface Coatings & Technology, 2008, pp. 2223-2235, vol. 202, Elsevier B.V.
Search Report for GB1202134.1 dated May 31, 2012; 2 pgs.

* cited by examiner

HARD COATINGS COMPRISING CUBIC PHASE FORMING COMPOSITIONS

FIELD

The present invention relates to hard refractory coatings for cutting tools and, in particular, to coatings comprising cubic phase forming compositions.

BACKGROUND

Incorporation of aluminum into titanium nitride (TiN) coatings is known to enhance the high temperature stability of such coatings. TiN, for example, begins oxidation at about 500° C. forming rutile $TiO_2$, thereby promoting rapid coating deterioration. Aluminum can slow degradative oxidation of a TiN coating by forming a protective aluminum-rich oxide film at the coating surface.

While providing enhancement to high temperature stability, aluminum can also induce structural changes in a TiN coating having a negative impact on coating performance. Increasing amounts of aluminum incorporated into a TiN coating can induce growth of hexagonal close packed (hcp) aluminum nitride (AlN) phase, altering the crystalline structure of the coating from single phase cubic to a mixture of cubic and hexagonal phases. Aluminum content in excess of 70 atomic percent further alters the crystalline structure of the AlTiN layer to single phase hcp. Significant amounts of hexagonal phase can lead to a considerable reduction in hardness of AlTiN, resulting in premature coating failure or other undesirable performance characteristics. The inability to control hexagonal phase formation has obstructed full realization of the advantages offered by aluminum additions to TiN coatings.

SUMMARY

Refractory coatings for cutting tool applications and methods of making the same are described herein which, in some embodiments, permit incorporation of increased levels of aluminum into nitride coatings while reducing or maintaining levels of hexagonal phase in such coatings. Coatings and methods described herein, for example, employ cubic phase forming compositions for limiting hexagonal phase in nitride coatings of high aluminum content.

In one aspect, a coated cutting tool described herein comprises a substrate and a coating adhered to the substrate, the coating including a refractory layer comprising a plurality of sublayer groups, a sublayer group comprising a cubic phase forming nanolayer and an adjacent nanolayer of $M_{1-x}Al_xN$ wherein $x \geq 0.5$ and M is titanium or chromium, the refractory layer having 0.5 to 15 weight percent hexagonal phase. In some embodiments, $x \geq 0.6$ or $x \geq 0.7$. Further, a cubic phase forming nanolayer can comprise a cubic nitride, carbide or carbonitride of one or more metallic elements selected from the group consisting of yttrium, silicon and metallic elements of Groups IIIA, IVB, VB and VIB of the Periodic Table.

In another aspect, methods of making coated cutting tools are described herein. A method of making a coated cutting tool comprises providing a cutting tool substrate and depositing over a surface of the cutting tool substrate a coating including a refractory layer comprising a plurality of sublayer groups, a sublayer group comprising a cubic phase forming nanolayer and an adjacent nanolayer of $M_{1-x}Al_xN$ wherein $x > 0.5$ and M is titanium or chromium, the refractory layer deposited by physical vapor deposition and having 0.5 to 15 weight percent hexagonal phase.

In a further aspect, methods of enhancing performance of a refractory coating for cutting tool applications are described herein. A method of enhancing performance of a refractory coating for cutting tool applications comprises increasing the aluminum (Al) content of $M_{1-x}Al_xN$ nanolayers of the refractory coating to a value of $x \geq 0.5$ wherein M is titanium or chromium and maintaining 0.5 to 15 weight percent hexagonal phase in the refractory coating by depositing the $M_{1-x}Al_xN$ nanolayers on cubic phase forming layers. In some embodiments, the Al content is increased to a value of $x \geq 0.6$ or $x \geq 0.7$ while maintaining 0.5 to 15 weight percent hexagonal phase in the refractory coating.

These and other embodiments are described in greater detail in the detailed description which follows.

DETAILED DESCRIPTION

Figure 1:
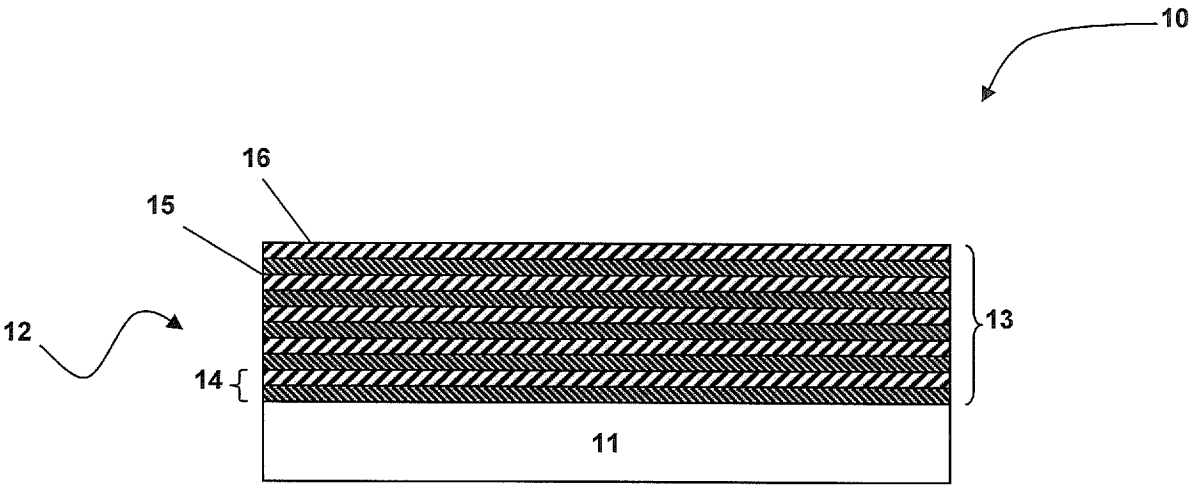
FIG. 1 illustrates a schematic of a coated cutting tool according to one embodiment described herein.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

I. Coated Cutting Tools

In one aspect, a coated cutting tool described herein comprises a substrate and a coating adhered to the substrate, the coating including a refractory layer comprising a plurality of sublayer groups, a sublayer group comprising a cubic phase forming nanolayer and an adjacent nanolayer of $M_{1-x}Al_xN$ wherein $x \geq 0.5$ and M is titanium or chromium, the refractory layer having 0.5 to 15 weight percent hexagonal phase. In some embodiments, x has a value selected from Table I.

TABLE I

| Al Content of $M_{1-x}Al_xN$ Nanolayer<br>Value of x in $M_{1-x}Al_xN$ |
|---|
| >0.6 |
| ≥0.65 |
| ≥0.7 |
| ≥0.75 |
| 0.6-0.8 |
| 0.65-0.75 |
| 0.7-0.8 |

The aluminum content of individual $M_{1-x}Al_xN$ nanolayers of a refractory layer can be substantially the same. Alternatively, aluminum content of individual nanolayers is not substantially the same and can be varied throughout the sublayer groups forming the refractory layer. For example, aluminum gradients can be established between $M_{1-x}Al_xN$ nanolayers of adjacent sublayer groups.

A $M_{1-x}Al_xN$ nanolayer is deposited on a cubic phase forming nanolayer to provide a sublayer group. While not wishing to be bound by any theory, it is believed that deposition of $M_{1-x}Al_xN$ on a cubic phase forming layer permits $M_{1-x}Al_xN$ to adopt the cubic crystalline structure of the cubic forming layer, thereby resulting in hexagonal phase reduction. Increasing amounts of aluminum, therefore, can be incorporated into $M_{1-x}Al_xN$ nanolayers while limiting hexagonal phase growth in the refractory layer formed by the sublayer groups. As described herein, a refractory layer can demonstrate 0.5 to 15 weight percent hexagonal phase, wherein $M_{1-x}Al_xN$ nanolayers have a value of x selected from Table I. In some embodiments, the refractory layer formed by the sublayer groups has hexagonal phase content according to Table II.

TABLE II

| Hexagonal Phase Content of Refractory Layer<br>Refractory Layer Hexagonal Phase (wt. %) |
|---|
| 1-10 |
| 0.5-5 |
| 1-3 |

A cubic phase forming nanolayer can comprise a cubic nitride, cubic carbide or cubic carbonitride of one or more metallic elements selected from the group consisting of yttrium, silicon and metallic elements of Groups IIIA, IVB, VB and VIB of the Periodic Table. In some embodiments, for example, a cubic phase forming nanolayer is selected from the group consisting of titanium nitride, titanium carbide, zirconium nitride, tantalum carbide, niobium carbide, niobium nitride, hafnium nitride, hafnium carbide, vanadium carbide, vanadium nitride, chromium nitride, aluminum titanium nitride, cubic boron nitride, aluminum chromium nitride, titanium carbonitride and aluminum titanium carbonitride. Further, in some embodiments, a cubic phase forming nanolayer displays hexagonal phase in addition to the cubic phase. A cubic phase forming nanolayer of AlTiN or AlCrN, for example, can demonstrate low amounts of hexagonal phase.

Thickness of a sublayer group comprising a $M_{1-x}Al_xN$ nanolayer deposited on a cubic phase forming nanolayer can generally range from 5 nm to 50 nm. In some embodiments, a sublayer group has a thickness in the range of 10 nm to 40 nm. Thickness of an individual $M_{1-x}Al_xN$ nanolayer can range from 5 nm to 30 nm with the thickness of an individual cubic phase forming nanolayer ranging from 2 nm to 20 nm.

Further, nanolayers of $M_{1-x}Al_xN$ and cubic phase forming compositions can demonstrate grain size distributions of 1 nm to 15 nm. Grain size distributions of nanolayers described herein can be determined according to X-ray diffraction (XRD) techniques. Crystallite or grain size determination by XRD is the result of ascertaining the integral peak width and peak shape of the diffracted sample pattern. The analysis of grain size by the Rietveld method is based on the change of the parameters to determine the sample peak profile compared to a standard peak profile. The profile parameters depend on the instrument settings used for data collection and on the profile function used for refinement.

XRD analysis is completed using a grazing incidence technique and XRD instrumentation and settings described below for hexagonal phase determination. A size-strain standard is measured. NIST standard SRM 660b Line Position and Line Shape Standard for Powder Diffraction is used for this purpose. A high quality scan is obtained for the standard (e.g. ≥140 degrees 2θ) with optics tuned for resolution. The standard structure is loaded and refined. Suitable Rietveld refinement parameters are provided in the description of hexagonal phase determination below. The Rietveld refinement for crystallite size depends on the profile function used to identify the peaks and typically includes:

| | |
|---|---|
| U parameter | describes peak FWHM |
| V parameter | describes peak FWHM |
| W parameter | describes peak FWHM |
| Peak Shape 1 | describes the peak shape function parameter |
| Peak Shape 2 | describes the peak shape function paramete |
| Peak Shape 3 | describes the peak shape function parameter |
| Asymmetry | describes peak asymmetry for the Rietveld or Howard Model |

Refinement of the standard defines the peak profile parameters strictly due to the instrument. This refinement is saved as the instrument peak broadening standard. The unknown sample data is imported into this standard refinement and then has peak profile refinement completed using the same parameters as the size standard. The results of the refinement of the peak profiles on the unknown sample determine the crystallite size.

As described further herein, a plurality of sublayer groups is deposited by physical vapor deposition to provide a refractory layer of the coating. The refractory layer formed by the sublayer groups can have any thickness not inconsistent with the objectives of the present invention. The refractory layer, for example, can have a thickness ranging from about 1-15 μm. In some embodiments, the refractory layer has a thickness of 1-10 μm or from 2-6 μm.

FIG. 1 is a schematic of a coated cutting tool according to one embodiment described herein. The coated cutting tool (10) of FIG. 1 comprises a cutting tool substrate (11) and a coating (12) adhered to the substrate (11). The coating (12) is comprised of a refractory layer (13) having a plurality of sublayer groups (14). A sublayer group (14) comprises a cubic phase forming nanolayer (15) and an adjacent nanolayer of $M_{1-x}Al_xN$ (16). The sublayer groups (14) are repeated or stacked to provide the refractory layer (13) the desired thickness.

In some embodiments, a coating adhered to the cutting tool substrate can further comprise one or more layers in addition to the refractory layer formed of sublayer groups comprising cubic phase forming nanolayers and adjacent nanolayers of $M_{1-x}Al_xN$. Additional layer(s) of the coating can be positioned between the refractory layer and the substrate and/or over the refractory layer. Additional layer(s) of the coating can comprise one or more metallic elements selected from the group consisting of aluminum and metallic elements of Groups IVB, VB and VIB of the Periodic Table and one or more non-metallic elements selected from the group consisting of nonmetallic elements of Groups IIIA, IVA, VA and VIA of the Periodic Table. For example, in some embodiments, one or more additional layers of TiN, AlTiN, TiC, TiCN or $Al_2O_3$ can be positioned between the cutting tool substrate and the refractory layer. Additional layer(s) can have any desired thickness not inconsistent with the objectives of the present invention. In some embodiments, an additional layer has a thickness in the range of 100 nm to 5 μm.

Figure 2:
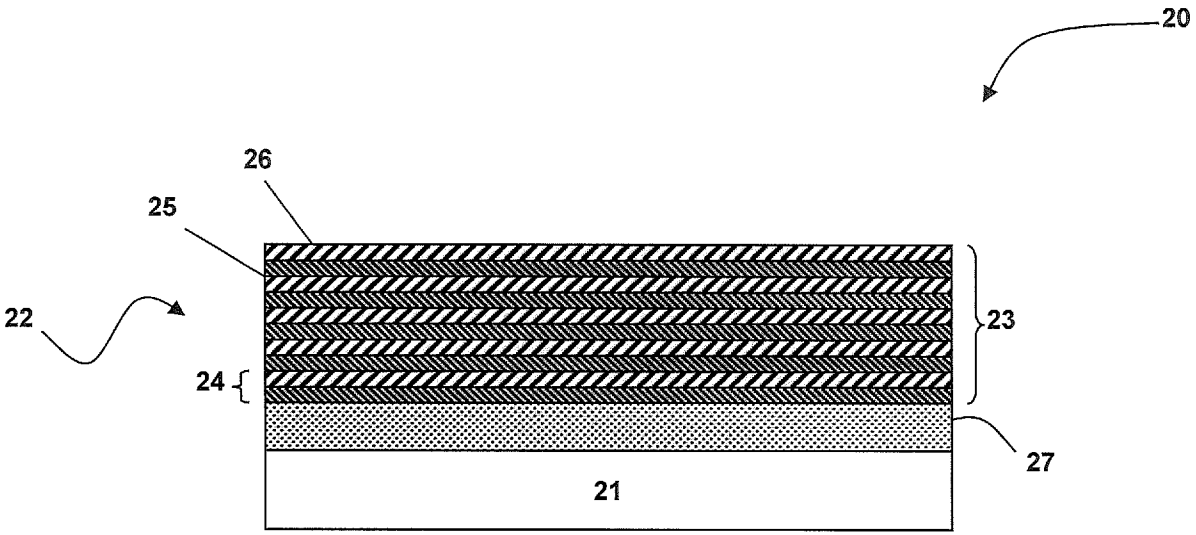
FIG. 2 illustrates a schematic of a coated cutting tool according to one embodiment described herein.

FIG. 2 illustrates a schematic of a coated cutting tool according to one embodiment described herein. The coated cutting tool (20) of FIG. 2 comprises a cutting tool substrate (21) and a coating (22) adhered to the substrate (21). The coating (22) comprises a refractory layer (23) having a plurality of sublayer groups (24). As in FIG. 1, a sublayer group (24) comprises a cubic phase forming nanolayer (25) and an adjacent nanolayer of $M_{1-x}Al_xN$ (26). The sublayer groups (24) are repeated or stacked to provide the refractory layer (23) the desired thickness. An intermediate layer (27) is positioned between the cutting tool substrate (21) and the refractory layer (23).

A coated cutting tool can comprise any substrate not inconsistent with the objectives of the present invention. A substrate, in some embodiments, is an end mill, drill or indexable cutting insert of desired ANSI standard geometry for milling or turning applications. Substrates of coated cutting tools described herein can be formed of cemented carbide, carbide, ceramic, cermet or steel. A cemented carbide substrate, in some embodiments, comprises tungsten carbide (WC). WC can be present in a cutting tool substrate in an amount of at least about 80 weight percent or in an amount of at least about 85 weight percent. Additionally, metallic binder of cemented carbide can comprise cobalt or cobalt alloy. Cobalt, for example, can be present in a cemented carbide substrate in an amount ranging from 3 weight percent to 15 weight percent. In some embodiments, cobalt is present in a cemented carbide substrate in an amount ranging from 5-12 weight percent or from 6-10 weight percent. Further, a cemented carbide substrate may exhibit a zone of binder enrichment beginning at and extending inwardly from the surface of the substrate.

Cemented carbide cutting tool substrates can also comprise one or more additives such as, for example, one or more of the following elements and/or their compounds: titanium, niobium, vanadium, tantalum, chromium, zirconium and/or hafnium. In some embodiments, titanium, niobium, vanadium, tantalum, chromium, zirconium and/or hafnium form solid solution carbides with WC of the substrate. In such embodiments, the substrate can comprise one or more solid solution carbides in an amount ranging from 0.1-5 weight percent. Additionally, a cemented carbide substrate can comprise nitrogen.

Figure 3:
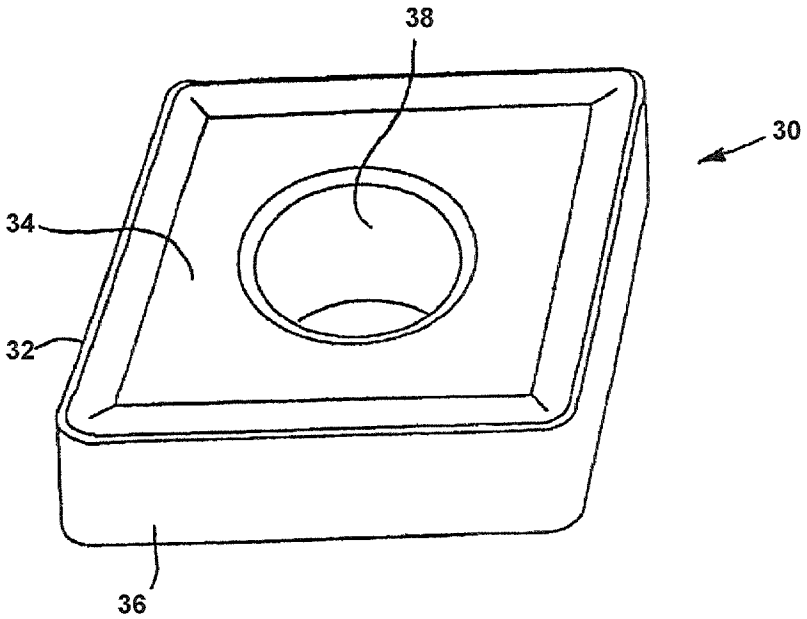
FIG. 3 illustrates a schematic of a cutting tool substrate according to one embodiment described herein.

A cutting tool substrate can comprise one or more cutting edges formed at the juncture of a rake face and flank face(s) of the substrate. FIG. 3 illustrates a cutting tool substrate according to one embodiment described herein. As illustrated in FIG. 3, the substrate (30) has cutting edges (32) formed at junctions of the substrate rake face (34) and flank faces (36). The substrate (30) also comprises an aperture (38) for securing the substrate (30) to a tool holder.

Phase determination, including hexagonal phase determination, of refractory coatings described herein is determined using x-ray diffraction (XRD) techniques and the Rietveld refinement method, which is a full fit method. The measured specimen profile and a calculated profile are compared. By variation of several parameters known to one of skill in the art, the difference between the two profiles is minimized. All phases present in a coating layer under analysis are accounted for in order to conduct a proper Rietveld refinement.

A cutting tool comprising a refractory coating described herein can be analyzed according to XRD using a grazing incidence technique requiring a flat surface. The cutting tool rake face or flank face can be analyzed depending on cutting tool geometry. XRD analysis of coatings described herein was completed using a parallel beam optics system fitted with a copper x-ray tube. The operating parameters were 45 KV and 40 MA. Typical optics for grazing incidence analysis included an x-ray mirror with 1/16 degree antiscatter slit and a 0.04 radian soller slit. Receiving optics included a flat graphite monochromator, parallel plate collimator and a sealed proportional counter. X-ray diffraction data was collected at a grazing incidence angle selected to maximize coating peak intensity and eliminate interference peaks from the substrate. Counting times and scan rate were selected to provide optimal data for the Rietveld analysis. Prior to collection of the grazing incidence data, the specimen height was set using x-ray beam splitting.

A background profile was fitted and peak search was performed on the specimen data to identify all peak positions and peak intensities. The peak position and intensity data was used to identify the crystal phase composition of the specimen coating using any of the commercially available crystal phase databases.

Crystal structure data was input for each of the crystalline phases present in the specimen. Typical Rietveld refinement parameters settings are:

| | |
|---|---|
| Background calculation method: | Polynomial |
| Sample Geometry: | Flat Plate |
| Linear Absorption Coefficient: | Calculated from average specimen composition |
| Weighting Scheme: | Against lobs |
| Profile Function: | Pseudo-Voigt |
| Profile Base Width: | Chosen per specimen |
| Least Squares Type: | Newton-Raphson |
| Polarization Coefficient: | 1.0 |

The Rietveld refinement typically includes:

| | |
|---|---|
| Specimen Displacement: | shift of specimen from x-ray alignment |
| Background profile | selected to best describe the background profile of the diffraction data |
| Scale Function: | scale function of each phase |
| B overall: | displacement parameter applied to all atoms in phase |
| Cell parameters: | a, b, c and alpha, beta, and gamma |
| W parameter: | describes peak FWHM |

Any additional parameter to achieve an acceptable "Weighted R Profile"

All Rietveld phase analysis results are reported in weight percent values.

As described herein, cubic phase forming layers of sublayer groups in a refractory layer can permit $M_{1-x}Al_xN$ nanolayers to demonstrate increased aluminum fraction while limiting hexagonal phase growth in the refractory layer. The ability to increase aluminum content while limiting hexagonal phase formation enhances the high temperature stability of the refractory layer without significantly decreasing refractory layer hardness. For example, a refractory layer formed of sublayer groups described herein can have a hardness of at least about 25 GPa. Hardness values are determined according to ISO 14577 with a Vickers indenter at an indentation depth of 0.25 μm. In some embodiments, a refractory layer having a construction described herein has hardness according to Table III.

TABLE III

| Refractory Layer Hardness (GPa) Hardness, GPa |
|---|
| 25-35 |
| 25-30 |
| 27-35 |
| 30-35 |

II. Methods of Making Coated Cutting Tools

In another aspect, methods of making coated cutting tools are described herein. A method of making a coated cutting tool comprises providing a cutting tool substrate and depositing over a surface of the cutting tool substrate a coating including a refractory layer comprising a plurality of sublayer groups, a sublayer group comprising a cubic phase forming nanolayer and an adjacent nanolayer of $M_{1-x}Al_xN$ wherein $x \geq 0.5$ and M is titanium or chromium, the refractory layer deposited by PVD and having 0.5 to 15 weight percent hexagonal phase. In some embodiments, $M_{1-x}Al_xN$ nanolayers have an aluminum content selected from Table I herein. Further, the refractory layer can have a hexagonal phase content selected from Table II herein.

Thicknesses of cubic phase forming nanolayers and $M_{1-x}Al_xN$ nanolayers of sublayer groups can be controlled by adjusting target evaporation rates among other PVD parameters. As described herein, individual thicknesses of cubic phase forming nanolayers can range from 2-20 nm with individual thicknesses of $M_{1-x}Al_xN$ nanolayers ranging from 5-30 nm. Further, nanolayers of $M_{1-x}Al_xN$ and cubic phase forming compositions can demonstrate grain size distributions of 1 to 15 nm.

Any PVD process not inconsistent with the objectives of the present invention can be used for fabricating coated cutting tools according to methods described herein. For example, in some embodiments, cathodic arc evaporation or magnetron sputtering techniques can be employed to deposit coatings having architectures described herein. When using cathodic arc evaporation, biasing voltage is generally in the range of −40V to −100V with substrate temperatures of 400° C. to 600° C.

A refractory layer comprising a plurality of sublayer groups having a nanolayer construction can be deposited directly on one or more surfaces of the cutting tool substrate. Alternatively, a refractory layer comprising a plurality of sublayer groups can be deposited on an intermediate layer covering the substrate surface. An intermediate layer can comprise one or more metallic elements selected from the group consisting of aluminum and metallic elements of Groups IVB, VB and VIB of the Periodic Table and one or more non-metallic elements selected from the group consisting of nonmetallic elements of Groups IIIA, IVA, VA and VIA of the Periodic Table. For example, in some embodiments, a refractory layer comprising a plurality of sublayer groups is deposited on an intermediate layer of TiN, AlTiN, TiC, TiCN or $Al_2O_3$. An intermediate layer can have any thickness not inconsistent with the objectives of the present invention. An intermediate layer, for example, can have a thickness of 100 nm to 5 μm.

Further, one or more additional layers can be deposited over the refractory layer comprising the plurality of sublayer groups. Additional layer(s) deposited over the refractory layer can comprise one or more metallic elements selected from the group consisting of aluminum and metallic elements of Groups IVB, VB and VIB of the Periodic Table and one or more non-metallic elements selected from the group consisting of nonmetallic elements of Groups IIIA, IVA, VA and VIA of the Periodic Table.

In a further aspect, methods of enhancing performance of a refractory coating for cutting tool applications are described herein. A method of enhancing performance of a refractory coating for cutting tool applications comprises increasing the aluminum content of $M_{1-x}Al_xN$ nanolayers of the refractory coating to a value of $x \geq 0.5$ wherein M is titanium or chromium and maintaining 0.5 to 15 weight percent hexagonal phase in the refractory coating by depositing the $M_{1-x}Al_xN$ nanolayers on cubic phase forming nanolayers by PVD. In some embodiments, the Al content is increased to a value of $0.6 \leq x \leq 0.8$, wherein 0.5 to 15 weight percent hexagonal phase is maintained in the refractory coating. Further, in some embodiments, 1 to 10 weight percent or 0.5 to 5 weight percent hexagonal phase is maintained in the refractory coating, wherein the $M_{1-x}Al_xN$ nanolayers demonstrate an aluminum content of $0.6 \leq x \leq 0.8$.

Cubic phase forming nanolayers and $M_{1-x}Al_xN$ nanolayers of methods of enhancing refractory coating performance can have any properties described in Section I herein, including composition, thicknesses and grain size distributions.

These and other embodiments are further illustrated by the following non-limiting examples.

EXAMPLES

Examples of coated cutting tools described herein are set forth in Table IV as Examples 1-3. The coating of each example was comprised of a refractory layer having stacked sublayer groups, each sublayer group comprising a cubic phase forming nanolayer and a nanolayer of $Ti_{0.33}Al_{0.67}N$. The coatings were physical vapor deposited by cathodic arc evaporation on cemented carbide (WC-6 wt. % Co) indexable inserts [ANSI standard geometry CNMG432MP] at a substrate temperature of 550-600° C., biasing voltage of −60V to −80V, nitrogen partial pressure of 4.0-4.5 Pa and argon partial pressure of 0.5-1.0 Pa. INNOVA PVD apparatus from OC Oerlikon Baizers AG was employed for the coating deposition. Cubic phase forming nanolayers and nanolayers of $Ti_{1-x}Al_xN$ ($x>0.6$) were deposited in alternating succession using cathode constructions of Table IV to provide the refractory coatings. Individual sublayer groups of the coating displayed a thickness of about 30 nm. As provided in Table IV, cathode composition for cubic phase forming nanolayers was altered for each coating to demonstrate the efficacy of various cubic compositions for reducing or inhibiting hexagonal phase formation. Hexagonal phase of each coating was determined by XRD analysis as described in Section I hereinabove. The weight percent hexagonal phase for each example is also provided in Table IV.

TABLE IV

Examples of Coated Cutting Inserts

| Example | Cubic Phase Forming Nanolayer Cathode | $Ti_{1-x}Al_xN$ Nanolayer Cathode | Coating Thickness (μm) | Coating Grain Size (nm) | Coating Hexagonal Phase (wt. %) |
|---|---|---|---|---|---|
| 1 | Ti | $Ti_{0.33}Al_{0.67}$ | 2.8 μm | 9.2 | 2.3 |
| 2 | $Ti_{0.50}Al_{0.50}$ | $Ti_{0.33}Al_{0.67}$ | 2.7 μm | 11.6 | 2.5 |
| 3 | $Ti_{0.38}Al_{0.62}$ | $Ti_{0.33}Al_{0.67}$ | 2.8 μm | 8.1 | 12.6 |

Figure 4:
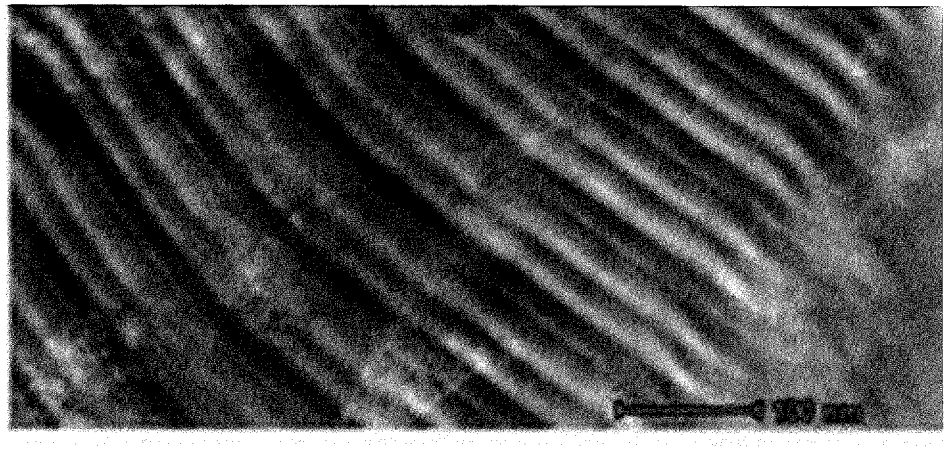
FIG. 4 is a scanning transmission electron microscopy image of a refractory layer comprising a plurality of sublayer groups according to one embodiment described herein.

FIG. 4 is a scanning transmission electron microscopy (STEM) image of a section of the refractory coating of Example 1 (scale bar 100 nm). As illustrated in FIG. 4, the light contrast represents cubic phase forming nanolayers of TiN, and the dark contrast represents nanolayers of TiAlN.

Figure 5:
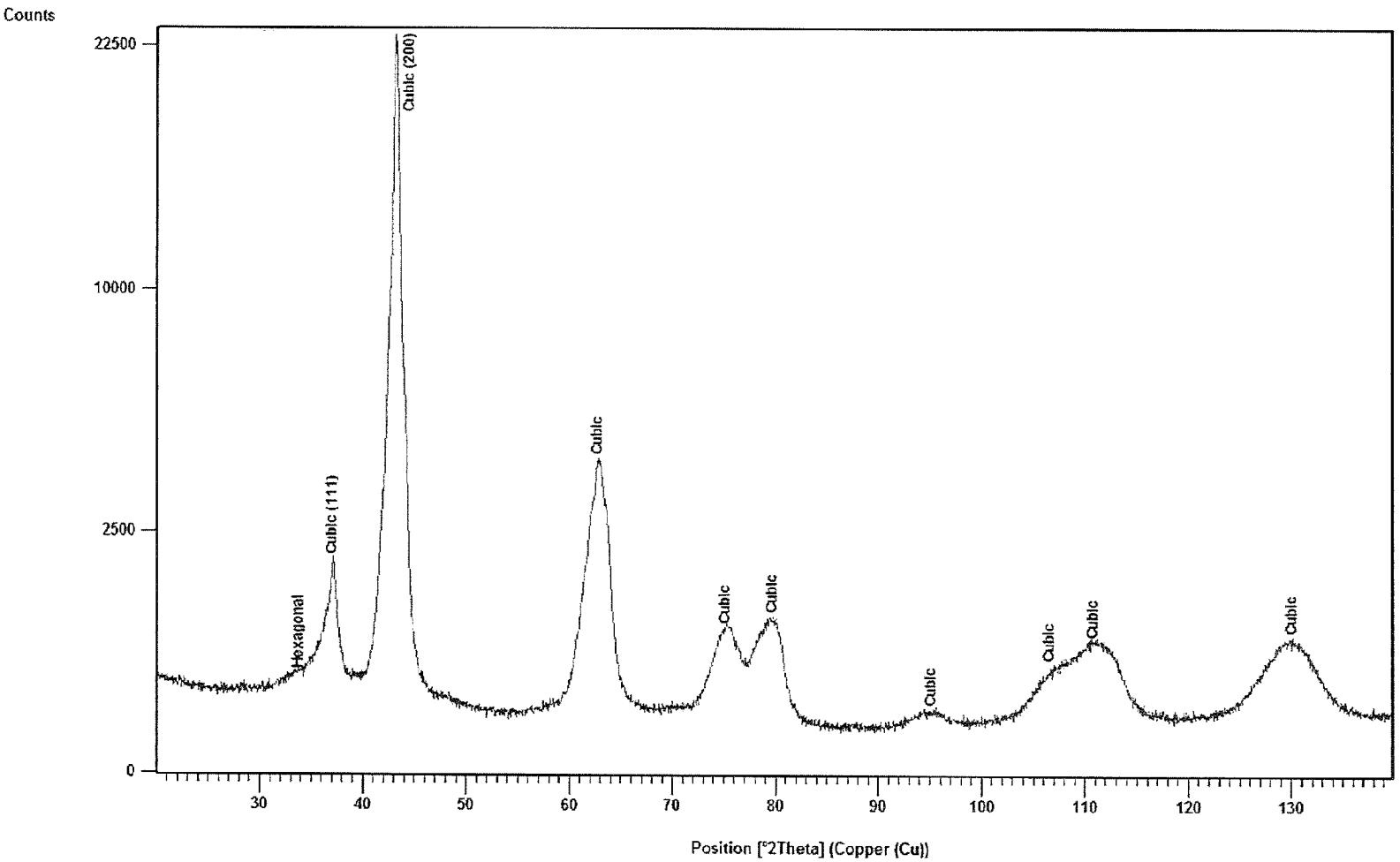
FIG. 5 is an X-ray diffractogram of a refractory coating according to one embodiment described herein.
Figure 6:
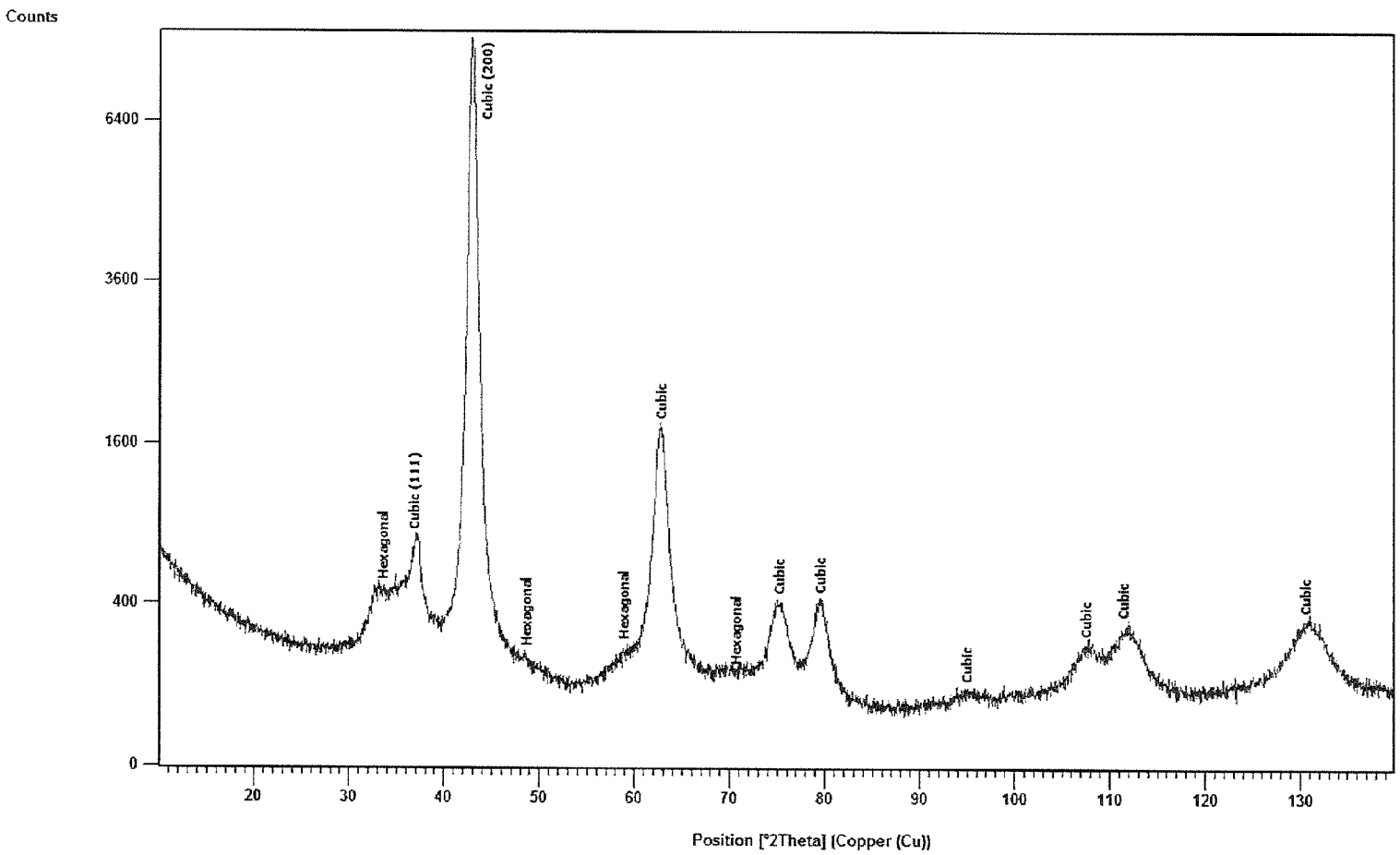
FIG. 6 is an X-ray diffractogram of a refractory coating according to one embodiment described herein.
Figure 7:
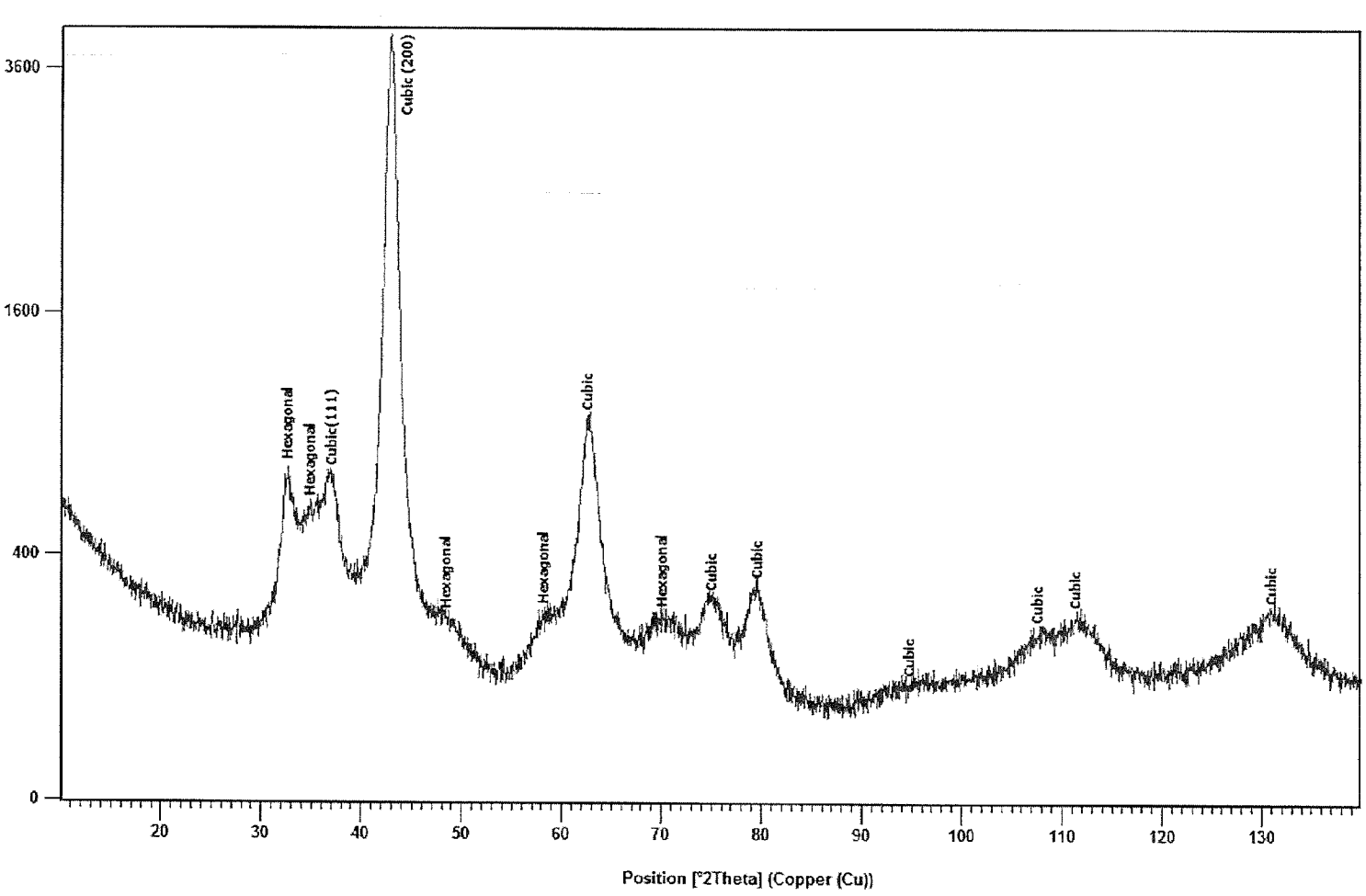
FIG. 7 is an X-ray diffractogram of a refractory coating according to one embodiment described herein.

As provided in Table IV, hexagonal phase was significantly reduced by cubic phase forming layers of no or low aluminum content. FIGS. 5-7 are X-ray diffractograms of Examples 1-3 respectively. Consistent with Table IV, hexagonal phase reflections in the diffractograms were more frequent and of greater intensity in Example 3 in comparison to Examples 1 and 2.

Further, hardness of each coating was determined according to ISO 14577 at an indentation depth of 0.25 μm. Results of the hardness testing are provided in Table V.

TABLE V

| Coating Hardness (GPa) | |
|---|---|
| Example | Hardness (GPa) |
| 1 | 30.3 |
| 2 | 29.8 |
| 3 | 25.2 |

As expected, Examples 1 and 2 having the lowest hexagonal phase content demonstrated the highest hardness values.

Coated cutting tools described herein were also subjected to metal cutting lifetime testing in comparison to prior coated cutting tool architecture. Cutting inserts (A, B and C) each having the architecture of Example 1 of Table IV were produced as set forth above. Comparative cutting inserts (D, E and F) displayed a single-phase cubic PVD TiAlN coating. Comparative cutting inserts D-F also demonstrated ANSI standard geometry CNMG432MP. Further, coating thicknesses of inserts A-C and comparative inserts D-F were in the range of 2-3.5 μm. Each of the coated cutting tools was subjected to cutting lifetime testing as follows:

Workpiece—304 Stainless Steel
Speed—300 sfm (91 m/min)
Feed Rate—0.016 ipr (0.41 mm/rev)
Depth of Cut—0.080 inch (2.03 mm)
Lead Angle: −5°
Coolant—Flood
End of Life was registered by one or more failure modes of:
Uniform Wear (UW) of 0.012 inches
Max Wear (MW) of 0.012 inches
Nose Wear (NW) of 0.012 inches
Depth of Cut Notch Wear (DOCN) Of 0.012 inches
Trailing Edge Wear (TW) of 0.012 inches To remove potential artifacts resulting from workpiece compositional and mechanical variances, coated cutting tools A and D were tested on a first 304SS workpiece, coated cutting tools B and E were tested on a second 304SS workpiece and coated cutting tools C and F were tested on a third 304SS workpiece. The results of the cutting lifetime testing are provided in Table VI.

TABLE VI

| Coated Cutting Tool Lifetime (minutes) | | |
|---|---|---|
| Coated Cutting Tool | Lifetime (minutes) | Failure Mode |
| A | 23 | DOCN |
| D | 22.5 | DOCN |
| B | 26 | DOCN |
| E | 18 | DOCN |
| C | 38.5 | DOCN |
| F | 25.1 | DOCN |

As provided in Table VI, cutting tools A-C having an architecture of sublayer groups comprising cubic phase forming nanolayers and TiAlN nanolayers having increased aluminum content demonstrated similar or enhanced cutting lifetimes relative to comparative cutting tools D-F.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. A coated cutting tool comprising:
a substrate; and
a coating adhered to the substrate, the coating including a refractory layer deposited by physical vapor deposition and comprising a plurality of sublayer groups, a sublayer group comprising a cubic phase forming nanolayer and an adjacent nanolayer of $M_{1-x}Al_xN$ wherein $x \geq 0.5$ and M is titanium or chromium, the refractory layer having 0.5 to 15 weight percent hexagonal phase.

2. The coated cutting tool of claim 1, wherein $x \geq 0.65$.

3. The coated cutting tool of claim 2, wherein the refractory layer has 0.5 to 5 weight percent hexagonal phase.

4. The coated cutting tool of claim 2, wherein the refractory layer has 1 to 3 weight percent hexagonal phase.

5. The coated cutting tool of claim 1, wherein $0.7 \leq x \leq 0.8$.

6. The coated cutting tool of claim 1, wherein the cubic phase forming nanolayer comprises a cubic nitride, carbide or carbonitride of one or more metallic elements selected from the group consisting of yttrium, silicon and metallic elements of Groups IIIA, IVB, VB and VIB of the Periodic Table.

7. The coated cutting tool of claim 6, wherein the cubic phase forming nanolayer is selected from the group consisting of titanium nitride, titanium carbide, zirconium nitride, cubic boron nitride, tantalum carbide, niobium carbide, niobium nitride, hafnium nitride, hafnium carbide, vanadium carbide, vanadium nitride, chromium nitride, aluminum titanium nitride, aluminum chromium nitride, titanium carbonitride and aluminum titanium carbonitride.

8. The coated cutting tool of claim 6, wherein the cubic phase forming nanolayer is selected from the group consisting of titanium nitride and aluminum titanium nitride.

9. The coated cutting tool of claim 6, wherein the cubic phase forming nanolayer comprises hexagonal phase.

10. The coated cutting tool of claim 1, wherein the cubic phase forming nanolayer has a thickness in the range of 2 nm to 20 nm.

11. The coated cutting tool of claim 10, wherein the nanolayer of $M_{1-x}Al_xN$ has a thickness in the range of 5 nm to 30 nm.

12. The coated cutting tool of claim 1, wherein the refractory layer has a hardness of 25 to 35 GPa according to ISO 14577 at an indentation depth of 0.25 μm.

13. The coated cutting tool of claim 1, wherein the refractory layer has a thickness in the range of 1 μm to 15 μm.

14. The coated cutting tool of claim 1, wherein the substrate is formed of cemented carbide, carbide, ceramic or steel.

15. The coated cutting tool of claim 1, wherein the cubic phase forming nanolayer comprises cubic carbide.

16. The coated cutting tool of claim 1, wherein cubic phase forming nanolayer has a grain size distribution of 1 nm to 15 nm.

17. A coated cutting tool comprising:
a substrate; and
a coating adhered to the substrate, the coating including a refractory layer deposited by physical vapor deposition and comprising a plurality of sublayer groups, a sublayer group comprising a cubic phase forming nanolayer and an adjacent nanolayer of $M_{1-x}Al_xN$ wherein $x \geq 0.5$ and M is titanium or chromium, the refractory layer having 0.5 to 15 weight percent hexagonal phase and the cubic phase forming nanolayer having hexagonal phase.

18. The coated cutting tool of claim 17, wherein $0.6 \leq x \leq 0.8$.

19. The coated cutting tool of claim 17, wherein $0.7 \leq x \leq 0.8$.

20. The coated cutting tool of claim 17, wherein the refractory layer has a hardness of 25 to 35 GPa according to ISO 14577 at an indentation depth of 0.25 μm.

21. The coated cutting tool of claim 17, wherein the cubic phase forming nanolayer comprises a cubic nitride, carbide or carbonitride of one or more metallic elements selected from the group consisting of yttrium, silicon and metallic elements of Groups IIIA, IVB, VB and VIB of the Periodic Table.

22. The coated cutting tool of claim 17, wherein cubic phase forming nanolayer has a grain size distribution of 1 nm to 15 nm.

* * * * *